US007900804B2

(12) United States Patent
Hakozaki et al.

(10) Patent No.: US 7,900,804 B2
(45) Date of Patent: Mar. 8, 2011

(54) STAPLER AND STAPLE CARTRIDGE

(75) Inventors: Katsuya Hakozaki, Tokyo (JP); Kazuhiko Kishi, Tokyo (JP); Toshio Shimizu, Tokyo (JP); Kazuo Higuchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/632,731

(22) PCT Filed: Jul. 12, 2005

(86) PCT No.: PCT/JP2005/012856

§ 371 (c)(1),
(2), (4) Date: Jan. 18, 2007

(87) PCT Pub. No.: WO2006/009015

PCT Pub. Date: Jan. 26, 2006

(65) Prior Publication Data

US 2008/0061102 A1 Mar. 13, 2008

(30) Foreign Application Priority Data

Jul. 20, 2004 (JP) ..... P.2004-212339

(51) Int. Cl.
*B27F 7/21* (2006.01)
*B25C 5/02* (2006.01)

(52) U.S. Cl. ..... 227/120; 227/119; 227/82; 227/155; 227/88; 227/89; 227/135

(58) Field of Classification Search ..... 227/82, 227/119–120, 155, 88–89, 135
See application file for complete search history.

(56) References Cited

U.S. PATENT DOCUMENTS

| | | | | |
|---|---|---|---|---|
| 2,938,212 | A * | 5/1960 | Lerner | 227/86 |
| 3,009,156 | A * | 11/1961 | Lerner | 227/88 |
| 3,504,837 | A | 4/1970 | Cairatti et al. | |
| 3,834,602 | A * | 9/1974 | Obergfell | 227/120 |
| 4,623,082 | A * | 11/1986 | Kurosawa | 227/7 |
| 5,038,992 | A * | 8/1991 | Shiang et al. | 227/120 |
| 6,050,471 | A * | 4/2000 | Yagi | 227/119 |
| 7,243,830 | B2 * | 7/2007 | Kitamura et al. | 227/82 |
| 2006/0163308 | A1 * | 7/2006 | Kitamura et al. | 227/82 |

FOREIGN PATENT DOCUMENTS

| | | |
|---|---|---|
| EP | 0 637 487 A1 | 2/1995 |
| EP | 0 838 315 A2 | 4/1998 |
| FR | 1 551 897 A | 1/1969 |

(Continued)

*Primary Examiner* — Rinaldi I. Rada
*Assistant Examiner* — Michelle Lopez
(74) *Attorney, Agent, or Firm* — Morgan, Lewis & Bockius LLP

(57) ABSTRACT

A forming plate and a driver plate are held at a front portion of a path of supplying connected staples in a laminated state. A staple in a C-shape formed at an inside of a strike out path formed between a front end face of a supply path and a back face of the face plate arranged on a front side of the supply path is pressed to supply to inside of the strike out path toward the face plate by a pusher urged by a spring. The staple is struck out by the driver plate. The pusher is made to constitute a first pusher, and a second pusher for pressing a leg portion of the staple to the face plate is aligned to be arranged to a side of a staple strike out port of the first pusher.

12 Claims, 8 Drawing Sheets

FOREIGN PATENT DOCUMENTS

| | | | | |
|---|---|---|---|---|
| JP | 54-71266 | | | 5/1979 |
| JP | 54-71266 | U | | 5/1979 |
| JP | 1-132380 | | | 9/1989 |
| JP | 1-132380 | U | | 9/1989 |
| JP | 4-275884 | | | 10/1992 |
| JP | 2001-191262 | | | 7/2001 |
| JP | 2004291101 | A | * | 10/2004 |
| WO | 93/20977 | | | 10/1993 |
| WO | 2004/048054 | | | 6/2004 |
| WO | 2004/048054 | A1 | | 6/2004 |

* cited by examiner

STAPLER AND STAPLE CARTRIDGE

TECHNICAL FIELD

The present invention relates to a stapler and a staple cartridge including a guide mechanism of a staple capable of firmly striking out the staple without buckling a leg portion of the staple.

BACKGROUND ART

There is a stapler of a cartridge type for binding a staple by mounting a cartridge contained with a number of unformed straight staples to a magazine portion of an electric stapler, successively supplying the unformed staple at an inside of the cartridge to a strike out path formed at a front end of a path of supplying the staple of the cartridge, forming the unformed staple in a C-shape by a forming plate immediately before the strike out path and supplying the formed staple to an inside of the strike out path in which a driver plate is moved to slide, striking out the formed staple from the strike out path by the driver plate, and penetrating the staple leg through binding sheets arranged at a lower face of the cartridge.

A front end portion of the cartridge contained with the number of staples is formed with the strike out path for striking out a front one of the staples to the binding sheet, and the strike out path is formed between a front end face of the cartridge and a face plate attached to a front end portion of the cartridge. The driver plate driven reciprocally by a motor provided on a main body side of the electric stapler strikes out the staple arranged at the inside of the strike out path by advancing to inside of the strike out path formed at the front end portion of the cartridge and folds to bend a front end of a staple leg penetrated through the binding sheets arranged on a lower face side of the cartridge by a clincher mechanism.

According to an electric stapler according to the related art of the application, there is formed an anvil arranged at a lower face of the unformed staple immediately before the strike out path, the unformed staple is formed into a C-shape by the anvil and the forming plate, and the staple formed in the C-shape is supplied to the inside of the strike out path by a pusher arranged on a lower side of the anvil. The pusher is moved back when the unformed staple is formed into the C-shape by the forming plate, engaged with the rear face side of the staple formed in the C-shape and presses the formed staple to a front side by a spring urge force to supply to an inside of a groove formed at a back face of a face plate forming the strike out path. Further, the pusher presses the staple leg portion from the rear face side to guide the struck-out staple leg portion when the staple at the inside of the strike out path is struck out by the driver plate.

The pusher is moved back by bringing the staple leg in the midst of being formed by starting to form the unformed staple by the forming plate into contact with the pusher, and presses the staple in a direction of the strike out path by being engaged with the rear face side of the staple formed in the C-shape. When the pusher is moved back, a support force for pushing the staple arranged at the inside of the strike out path and in the midst of being back from the rear face side is lost to bring about a case in which the staple is not guided sufficiently. When a length of the staple leg formed in the C-shape is long, also a thickness of the binding sheets is large and therefore, a large penetration resistance is produced during a time period after landing a front end of the staple leg struck out by pressing a crown portion thereof by the driver plate on a surface of the binding sheets, until penetrating the front end of the staple leg through the binding sheets, a distance between the driver plate and the front end of the staple leg is large and therefore, when the support force from the rear side is lost as described above, jamming is liable to be brought about by buckling the staple leg.

Hence, WO2004/048054 discloses a staple in which a pusher is formed with a long guide piece continuous in a staple striking out direction by way of an inclined face to be formed to project integrally to a side of the face plate to advance to between two legs of the staple at the inside of the strike out path, and the staple leg is guided by the guide piece by forming the inclined face at a position of being engaged with the staple when a front end of the staple leg struck out by the driver plate is landed on the binding sheets.

However, also according to the electric stapler, the pusher is moved back simultaneously with folding to bend the straight staple into the C-shape by the forming plate on the rear face side of the driver plate and therefore, a front one of the formed staple is liable to be unstable by losing the support invariably. Therefore, there is a case in which the staple is buckled before finishing to penetrate the binding sheets in the midst of being struck out. There is brought about an unstable struck state to cause to bring about a failure in striking such as jamming or the like.

DISCLOSURE OF THE INVENTION

One or more embodiments of the invention provide a stapler and a staple cartridge having a mechanism for guiding a staple in which when the staple formed in a C-shape is struck out to a strike out path by a driver plate, buckling, jamming or the like of the staple is prevented from being brought about by effectively guiding a staple leg.

In accordance with one or more embodiments of the invention, in a stapler, at a front portion of a path of supplying connected staples connected with straight staples, a forming plate of folding to bend to form a front staple into a C-shape and a driver plate for striking out the formed staple are held in a laminated state, the staple in the C-shape formed by the forming plate at an inside of a strike out path formed between a front end face of the supply path and a back face of a face plate arranged on a front side of the supply path is pressed to supply to the inside of the strike out path by a pusher urged by a spring to the face plate, and the staple is struck out by the driver plate. The pusher is made to constitute a first pusher and a second pusher for pressing a leg portion of the staple to the face plate is arranged to align with a side of a staple strike out port of the first pusher.

Further, in accordance with one or more embodiments of the invention, the first pusher and the second pusher are formed with press portions for pressing the staple, and both sides of the press portion are formed with guide portions for guiding inner side faces of the two leg portions of the staple at the inside of the strike out path by way of a stepped difference continuously in a direction of striking out the staple.

Further, in accordance with one or more embodiments of the invention, a stapler is provided with a path of supplying connected staples, a face plate arranged on a front side of the supply path, a strike out path provided between a front end face of the supply path and the face plate, a first pusher provided at the inside of the strike out path and urged to the face plate, and a second pusher provided at the inside of the strike out path, arranged on a side of a staple strike out port of the first pusher, and urged to the face plate.

Further, in accordance with one or more embodiments of the invention, the first pusher and the second pusher are made to be movable independently from each other.

Further, in accordance with one or more embodiments of the invention, the stapler is further provided with a forming plate for forming to bend to form a front one staple of the connected staples into a C-shape, and a driver plate held in a state of being laminated with the forming plate for striking out the formed staple. The first pusher presses the formed staple to the face plate, and the second pusher presses a leg portion of the formed staple to the face plate.

In accordance with one or more embodiments of the invention, the stapler is further provided with a first press portion formed at the first pusher for pressing the staple, first guide portions formed on both sides of the first press portion by way of a stepped difference for guiding inner side faces of the two leg portions of the staple at the inside of the strike out path, a second press portion formed at the second pusher for pressing the staple, and second guide portions formed on both sides of the second press portion for guiding the inner side faces of the two leg portions of the staple at the inside of the strike out path.

In accordance with one or more embodiments of the invention, the first press portion includes a first inclined face and a first engaging face successive to the first inclined face, and the second press portion includes a second inclined face and a second engaging face successive to the second inclined face.

In accordance with one or more embodiments of the invention, a side of the strike out path of the first pusher is formed with a first inclined face, and a first engaging face successive to the first inclined face, and a side of the strike out path of the second pusher is formed with a second inclined face, and a second engaging face successive to the second inclined face.

In accordance with one or more embodiments of the invention, when the staple at the inside of the strike out path is struck out by the driver plate, and a crown portion of the staple at the inside of the strike out path is engaged with the first engaging face, the first pusher is pushed back against an urge force, and when the forming plate forms the staple at a successive position and the first pusher is further pushed back, the crown portion of the staple at the inside of the strike out path is supported by the second inclined face.

Further, in accordance with one or more embodiments of the invention, a staple cartridge is provided with a path of supplying connected staples, a first pusher provided on a lower side of the supply path and urged to a direction of supplying the connected staple, and a second pusher provided on a lower side of the first pusher, urged to the direction of supplying the connected staples and made to be movable independently from the first pusher.

Further, in accordance with one or more embodiments of the invention, the first pusher is made to be able to advance and retract to and from a strike out path formed between a front end face of the supply path and a face plate, and the second pusher is made to be able to advance and retract to and from the strike out path.

Other aspects and advantages of the invention will be apparent from the following description and the appended claims.

BRIEF DESCRIPTION OF THE DRAWINGS

FIG. 1(*a*) is a perspective view of a staple cartridge according to one or more embodiments of the invention along with a driver plate, a forming plate.

[FIG. 1(*b*)]

FIG. 1(*b*) is a front view showing the staple cartridge according to one or one or more of the invention along with the driver plate, the forming plate.

FIG. 2 is a vertical sectional view of the staple cartridge.

FIG. 3 is a plane view of a front end portion of the staple cartridge.

FIG. 4 is a perspective view enlarging a front portion of the staple cartridge.

FIG. 5 is a perspective view of a state of aligning to arrange a first pusher and a second pusher.

FIG. 6 is a vertical sectional side view enlarging a state before starting a staple binding operation.

FIG. 7 is a vertical sectional side view enlarging a state in the midst of striking out a staple.

FIG. 8 is a side view enlarging the state in the midst of striking out the staple.

FIG. 9 is an enlarged vertical sectional view in finishing to strike out and form the staple.

Figure 1A:
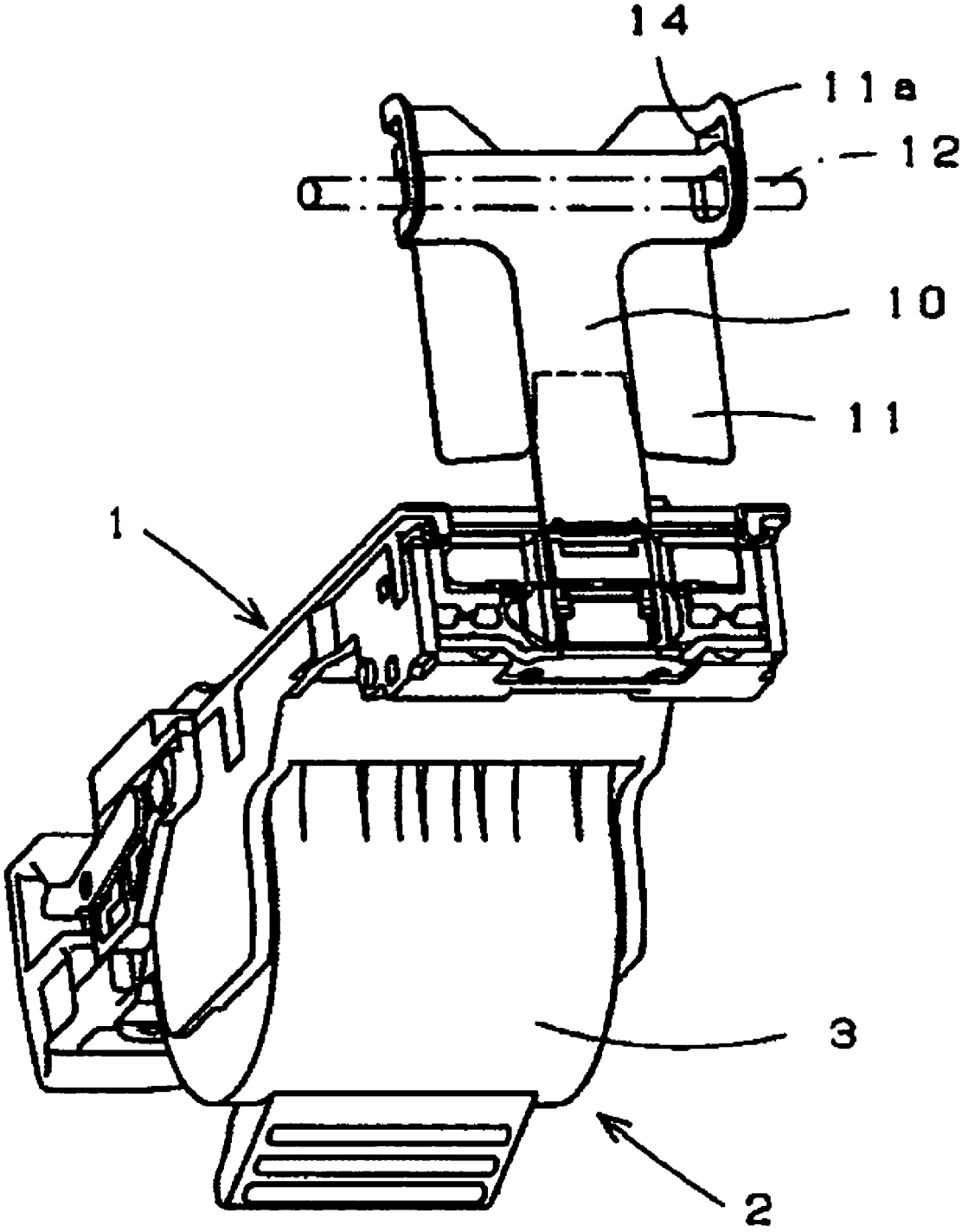
[FIG. 1(*a*)]

DESCRIPTION OF REFERENCE NUMERALS AND SIGNS s . . . staple
s1 . . . leg portion
10 . . . driver plate
11 . . . forming plate
7 . . . supply path
9 . . . strike out path
8 . . . face plate
15 . . . first pusher
16 . . . second pusher

BEST MODE FOR CARRYING OUT THE INVENTION

One or more embodiments of the invention will be explained in reference to the drawings as follows.

Embodiment

Figure 1B:
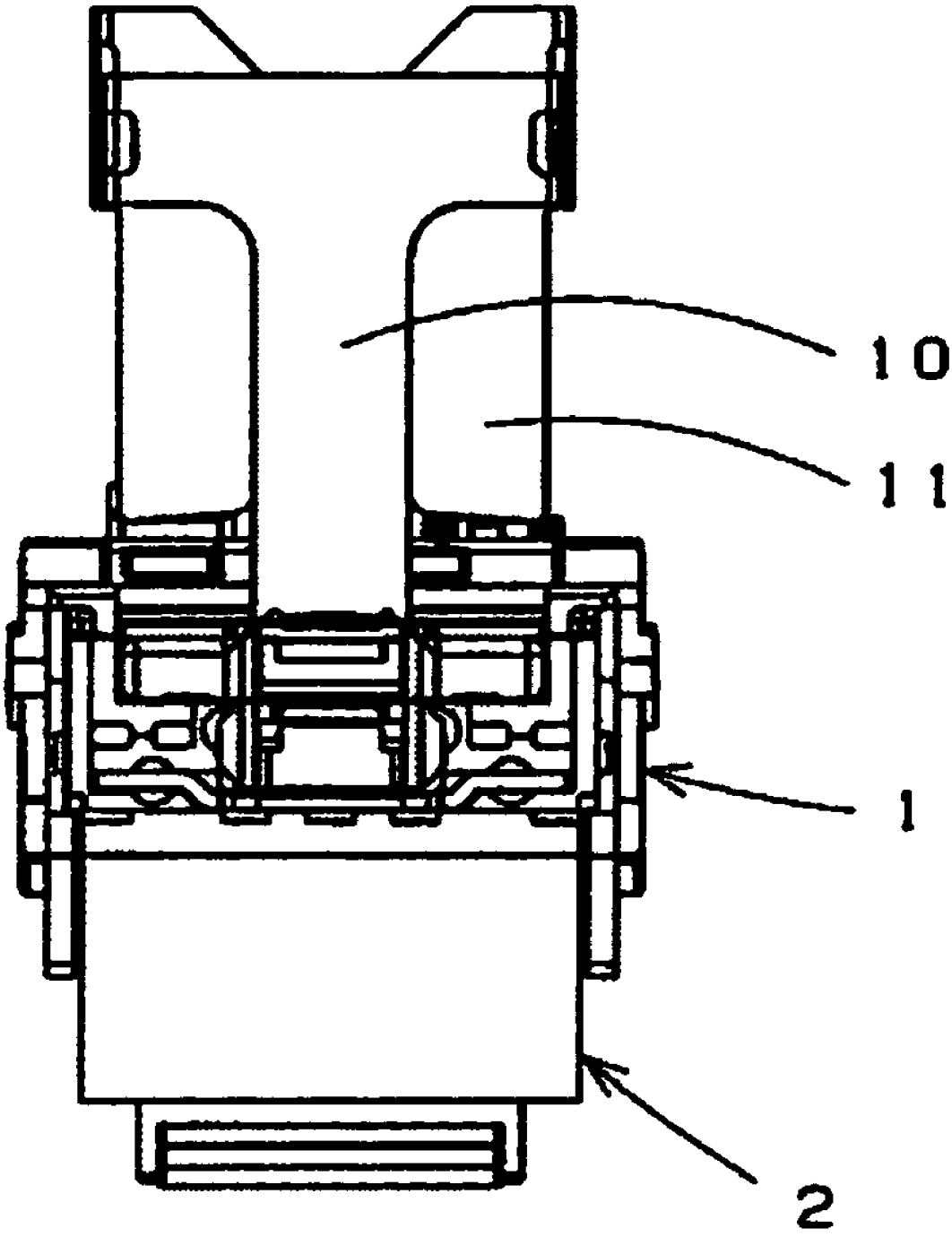
Figure 2:
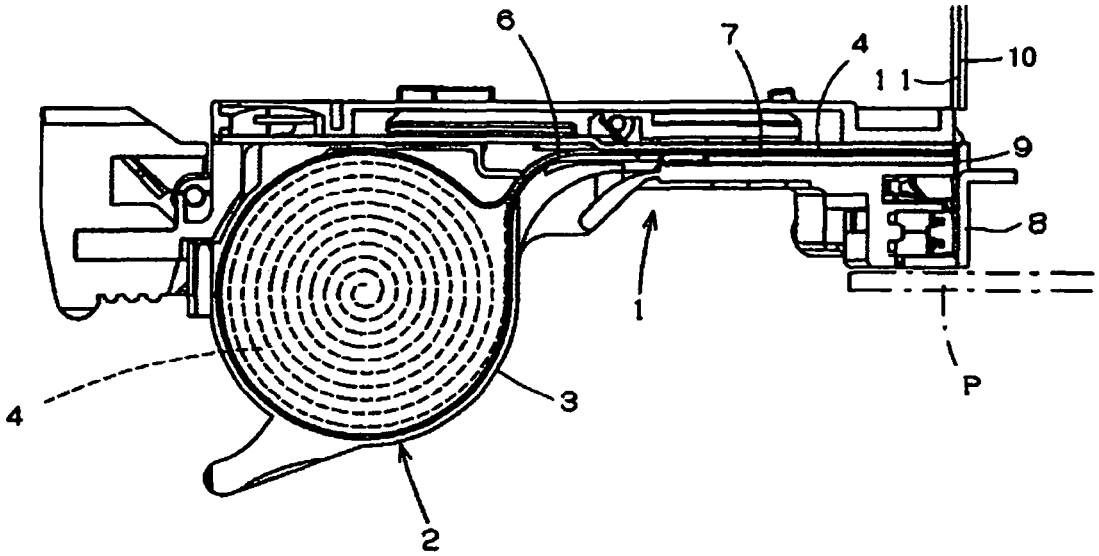
[FIG. 2]
Figure 3:
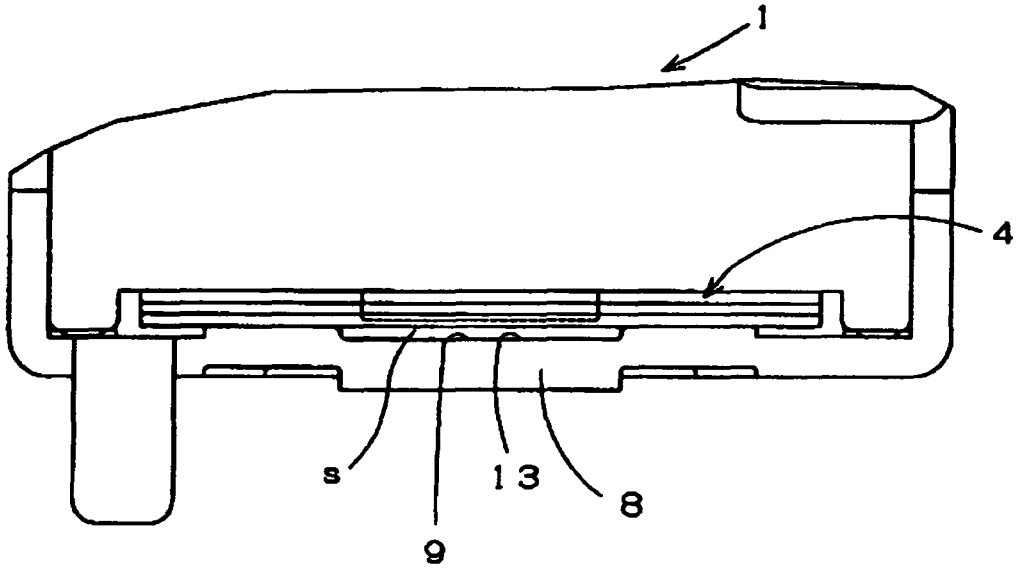
[FIG. 3]

In FIG. 1(*a*), FIG. 1(*b*) and FIG. 2, notation 1 designates a cartridge main body, notation 2 designates a refill. The refill 2 contains connected staples 4 connected with a number of unformed straight staples at an inside of a refill case 3 and is formed with a discharge port 6 of the connected staples 4 at a front end thereof. The refill 2 is made to be able to be attached and detached to and from the cartridge main body 1. The cartridge main body 1 is formed with the supply path 7 of the connected staples 4 continuously from the discharge port 6 of the refill 2 and the face plate 8 is arranged to be orthogonal to the supply path 7 on a front side thereof. Further, as shown by FIG. 3, the strike out path 9 of the staple is formed along an inner face of the face plate 8 between a front end face of the supply path 7 and a back face of the face plate 8 arranged on the front side of the supply path 7.

In contrast thereto, the staple cartridge is constituted to be set to a predetermined position of a main body of the electric stapler although not illustrated. As the electric stapler for setting the staple cartridge, there is conceived an electric stapler of an apparatus included type installed into an inside of an apparatus of, for example, a copier, a printer or a facsimile machine for automatically binding together a predetermined number of sheets of sheets copied, printed or received by a facsimile. The electric stapler main body is provided with a feed mechanism for supplying the connected staples 4 at an inside of the staple cartridge to the strike out path 9, and a strike mechanism for holding to drive the forming plate 11 for forming the unformed staple supplied to the front portion of the supply path 7 in a C-shape and the driver plate 10 for striking out a front one of the staple formed and supplied to the strike out path 9 in a laminated state. Further, a side of the staple cartridge opposed to the driver plate 10 is provided with a clincher member to be able to move in an up and down direction and is constituted to hold a binding sheet P set above a binding base provided at an upper portion of the staple cartridge of the drawing and fold to bend a leg portion of the staple struck out by the driver plate 10.

Further, although the driver plate 10 and the forming plate 11 are supported by a common drive shaft 12, an end portion flange 11*a* of the forming plate 11 is formed with a long hole 14 prolonged in a strike out direction, and the drive shaft 12 is engaged with the long hole 14. Therefore, although the driver is reciprocally moved along with the drive shaft 12, the forming plate 11 is reciprocally moved retardedly relative to the driver plate 10.

Further, the strike out path 9 is formed by a recess groove 13 formed at a back face of the face plate 8 and therefore, the front one of the unformed staple of the connected staples 4 cannot jump to the strike out path 9. Hence, the front one of the staple is folded to bend at both sides thereof by the forming plate 11 to be formed into a C-shape (a crown portion s1 and a leg portion s2 shown in FIG. 5) having a size of being brought to the strike out path 9 and thereafter supplied to the strike out path 9. The staple s fed to the strike out path 9 is struck out by the driver plate 10.

Figure 4:
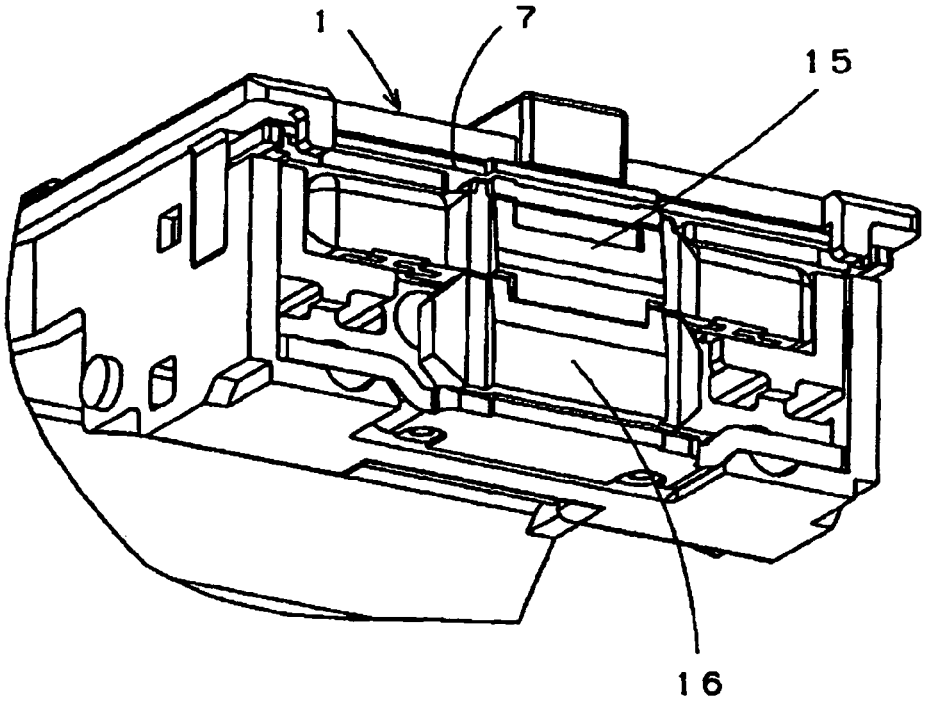
[FIG. 4]
Figure 5:
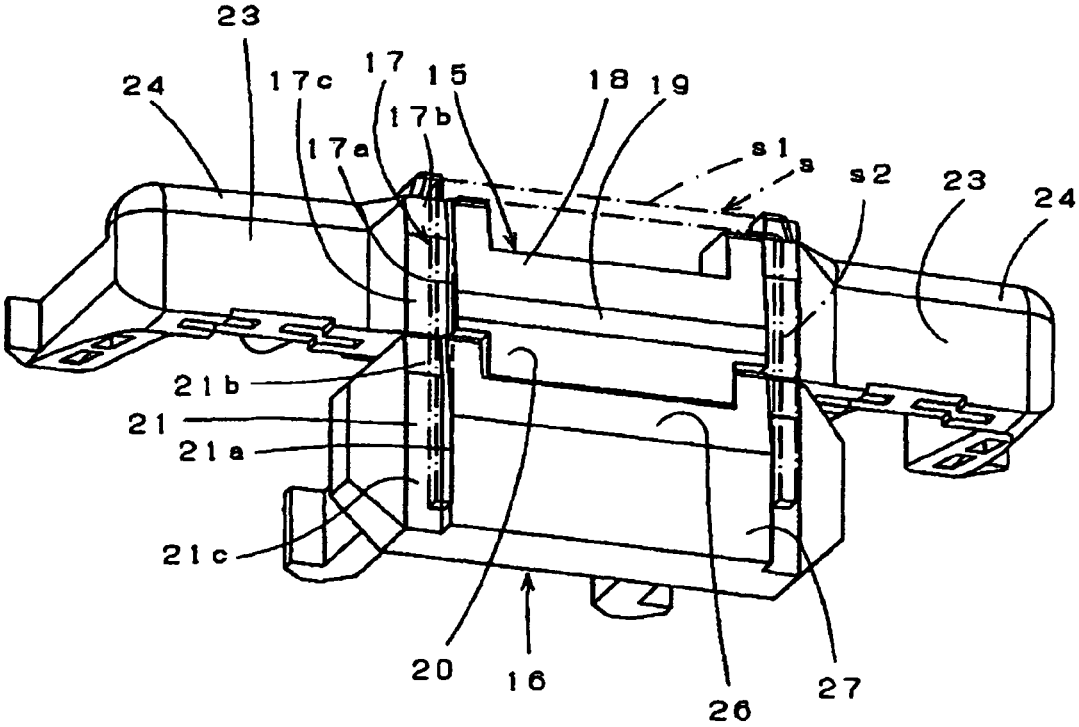
[FIG. 5]
Figure 6:
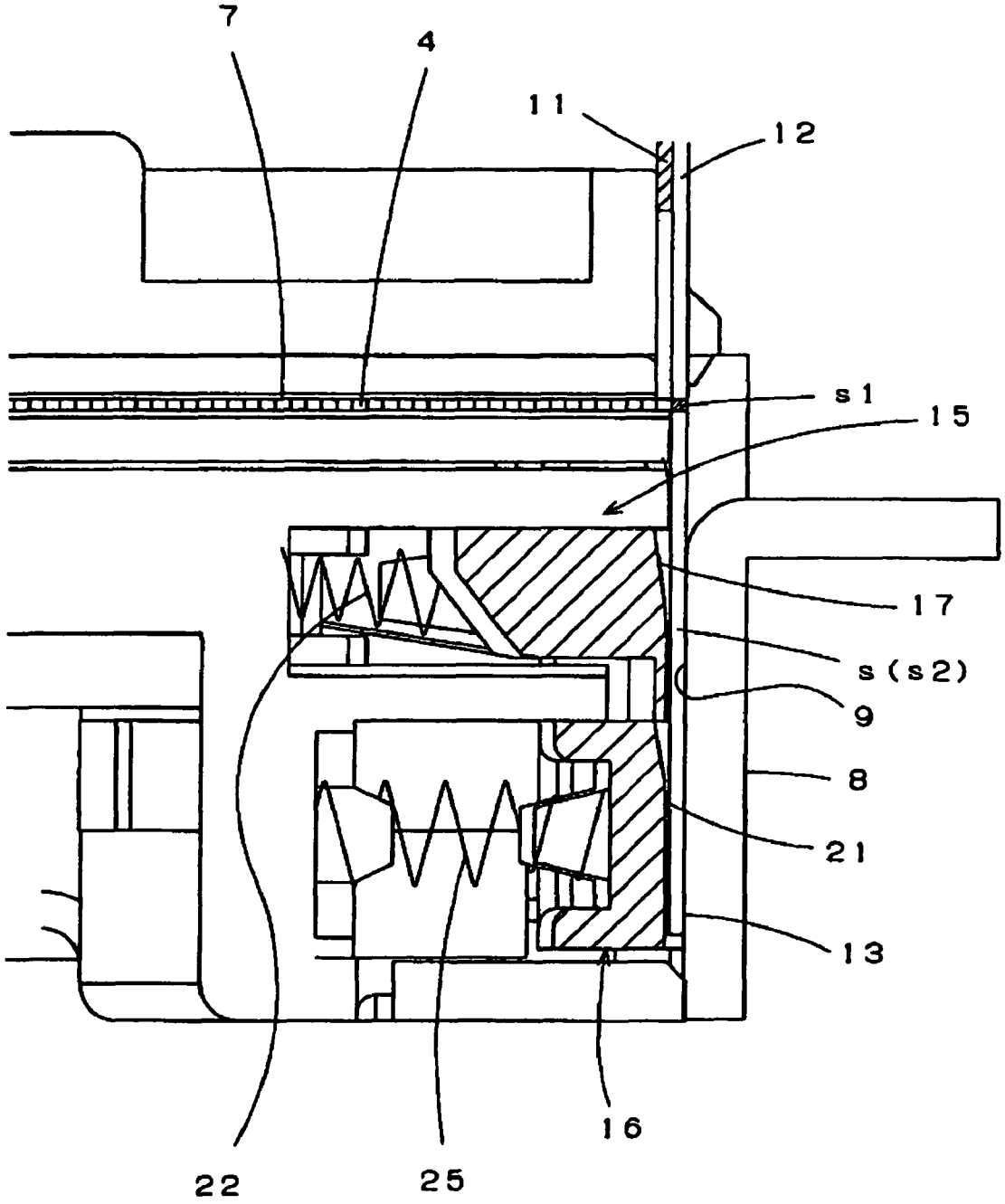
[FIG. 6]

As shown by FIG. 4, FIG. 5 and FIG. 6, a lower side of the supply path 7 is arranged with the first pusher 15 and the second pusher 16 as means for guiding the staple s slidably along a direction of supplying the connected staples 4. The first pusher 15 and the second pusher 16 are made to advance and retract to and from inside of the strike out path 9. The leg portion s2 of the staple s formed by the forming plate 11 is pushed out to be supplied to the strike out path 9 by the first pusher 15 and the second pusher 16. The staple is fed to the strike out path 9 and thereafter struck out by the driver plate 10, in that occasion, a front face and an outer side face of the staple s are guided by the recess groove 13 of the strike out path 9. In addition thereto, a rear face of the staple s is guided by the first pusher 15 and the second pusher 16.

The first pusher 15 is urged to the face plate 8 by a spring 22. Both sides of a front face of the first pusher 15 are formed with guide portions 17 (first guide faces 17) capable of being engaged with rear faces of the leg portions s2 of the formed staple, and inner sides of stepped differences 17*a* of the guide portions 17 are continuously formed with an inclined face 18 (first inclined face 18) on a side of the supply path 7 and an engaging face 19 (in parallel with an inner face of the face plate 8) successive thereto. A center of an end portion of the engaging face 19 (first engaging face 19) is formed with an extended portion 20 extended to a side of the second pusher 16. It is preferable that also the guide portion 17 is continuously formed with an inclined guide face 17*b* on a side of the supply path 7 and a strike out guide face 17*c* in parallel with the inner face of the face plate 8 as shown by FIG. 5.

Blade pieces 23 are extended to be formed on both outer sides of the guide portions 17, and upper end edges thereof are formed with inclined faces 24 for pushing back the first pusher 15 by being engaged with the staple leg portion s2 in the midst of being formed by the forming plate 11.

Next, the second pusher 16 is arranged to be aligned with a side of a staple strike out port q of the first pusher 15. Also the second pusher 16 is urged to the face plate 8 by a spring 25. A front face of the second pusher 16 is formed with a guide portion 21 (second guide face 21) capable of being engaged with the rear faces of the legs of the formed staple s, an inner side of a stepped difference 21*a* of the guide portion 21 is continuously formed with an inclined face 26 (second inclined face 26) on a side of the supply path 7 and an engaging face 27 (second engaging face 27) successive thereto. An end portion of the inclined face 26 is notched and is engaged with the extended portion 20 of the first pusher 15. It is preferable that the guide portion 21 is also formed such that the guide portion 21*b* is continuously formed with an inclined guide face 21*b* on a side of the supply path 7 and a strike out guide face 21*c* in parallel with the inner face of the face plate 8 as shown in FIG. 5.

Figure 7:
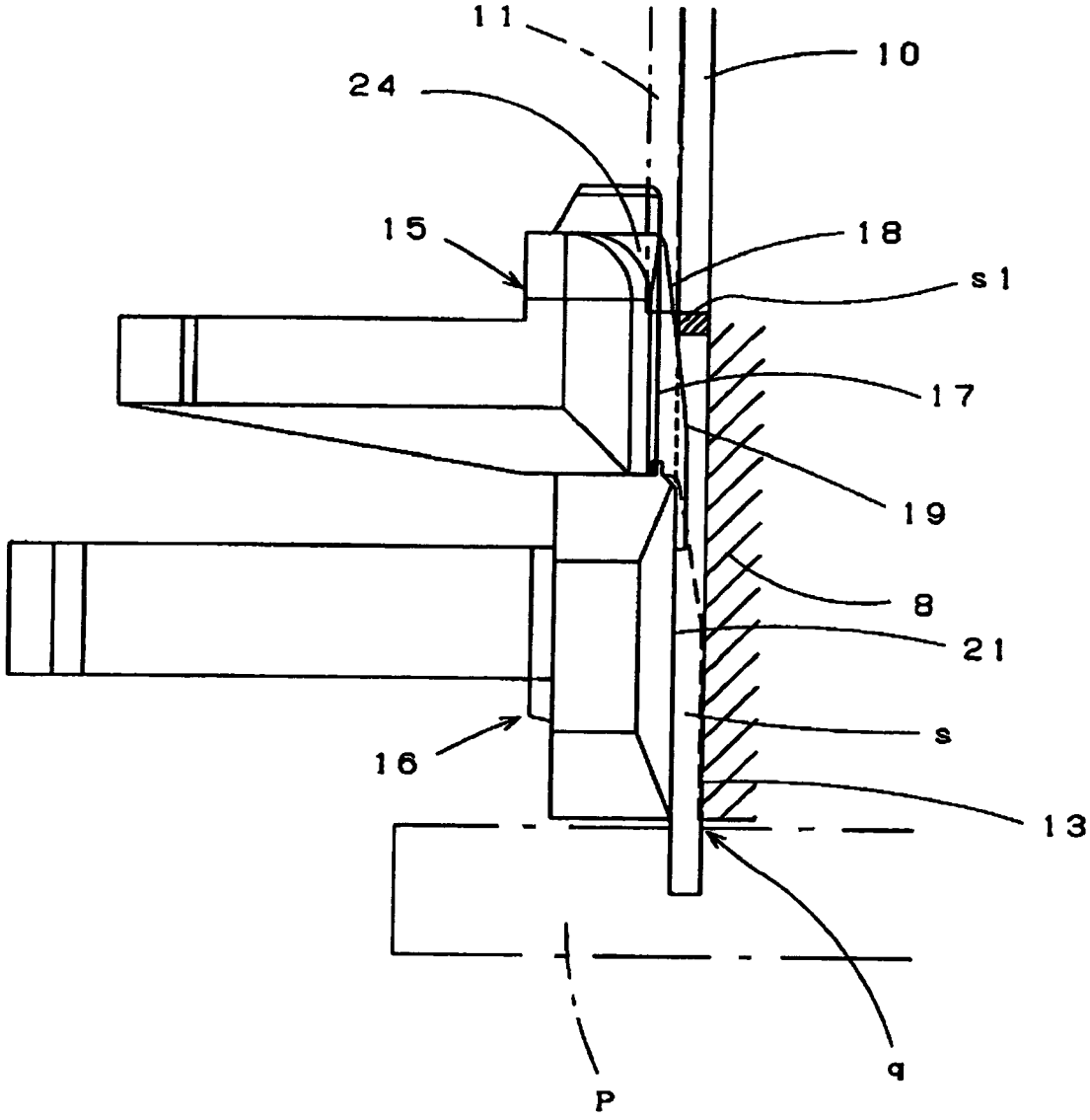
[FIG. 7]
Figure 8:
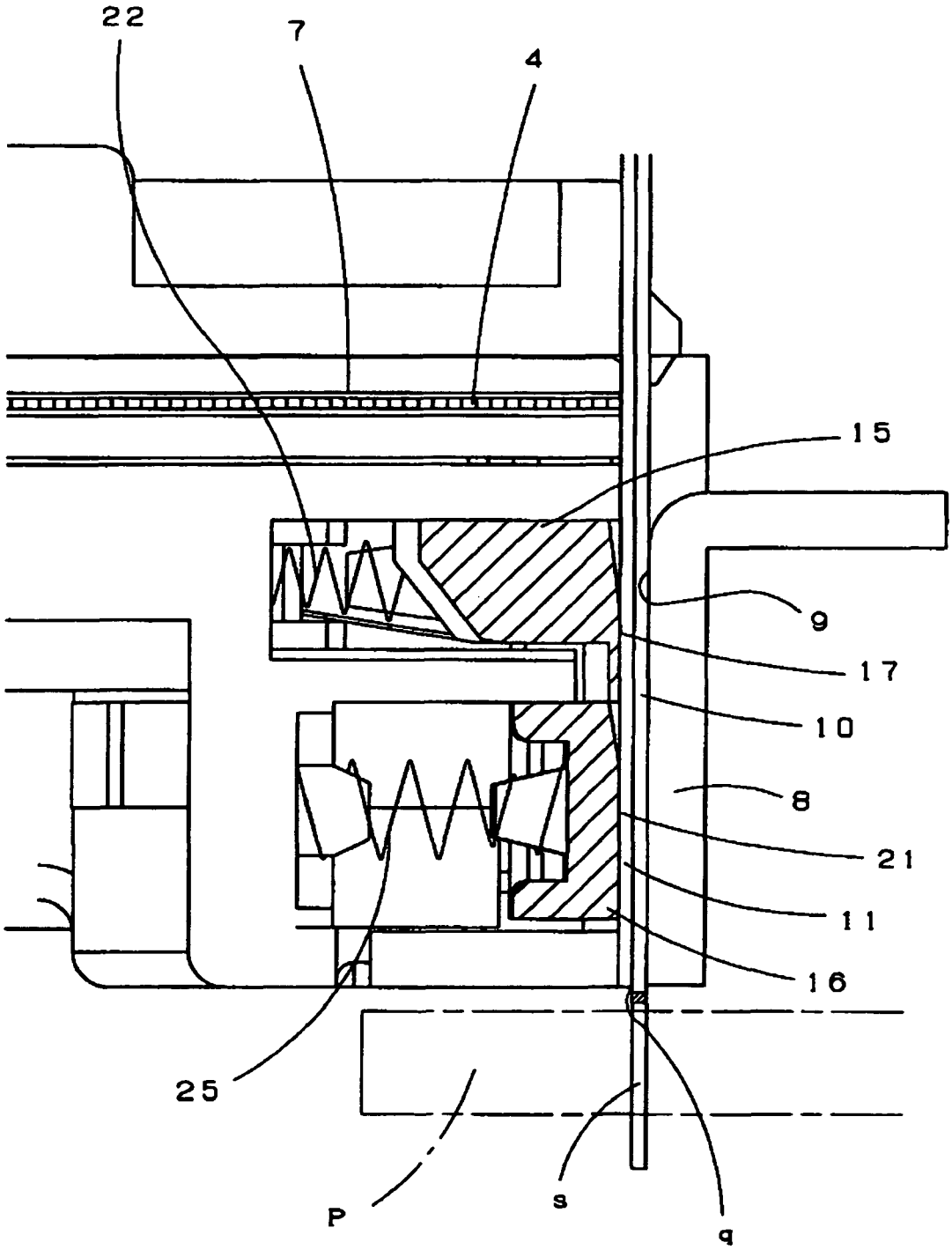
[FIG. 8]

Next, explaining a mode of operating the staple guide mechanism having the above-described constitution, first, when the staple has already been formed in the C-shape, the staple is pushed out to the strike out path 9 by the guide portions 17, 21 of the first pusher 15 and the second pusher 16 and pressed to be held by the springs 22, 25. Further, the leg portions s2 of the staple are held by the guide portions 17, 21 of the first pusher 15 and the second pusher 16. When the drive shaft 12 is operated by a strike mechanism of the stapler main body under the state, the driver plate 10 is driven and therefore, the staple s at the inside of the strike out path 9 is struck out. Although first, the staple s is guided by the guide portion 17 of the first pusher 15, as shown by FIG. 7, when the crown portion s1 of the staple s is butted to and supported by the inclined face 18 of the first pusher 15, and is engaged with the engaging face 19, the first pusher 15 is pushed back against the spring 22 (refer to FIG. 6). Further, successively to the driver plate 10, also the forming plate 11 is driven and therefore, both sides of a staple at a position next to the struck-out staple s are folded to bend, the folded to bend portion s1 is engaged with the upper end inclined face 24 of the blade piece 23 to further push back the first pusher 15 to the rear side. Therefore, the staple s in the midst of being struck out loses support. However, the leg portion s2 of the staple s has already been pressed to and supported by the side of the face plate 8 by the guide portion 21 of the second pusher 16. Further, also the crown portion s1 of the staple s is supported by the inclined face 26 of the second pusher 16 and therefore, the staple s is struck out to the binding sheet P in a correct attitude to penetrate therethrough. Thereafter, as shown by FIG. 8, also the second pusher 16 is pushed to be remote from the face plate 8 by the forming plate 11, however, at that occasion, the leg portion s2 of the staple s is inserted to and supported by the binding sheet P and therefore, the attitude of the staple s does not become unstable and the staple s is firmly penetrated through the binding sheets P.

Further, the leg portion s2 of the staple s is effectively prevented from being folded to bend to the inner side (side of other leg) by a resistance in penetrating through the binding sheet P since the leg portion s2 is guided by the guide portions 17, 21 of the first pusher 15 and the second pusher 16 moved independently from each other. Therefore, the binding operation can further firmly be operated without buckling the leg portion s2. Further, when the crown portion s1 of the staple is struck out, the crown portion s1 is struck out in a state of being brought into contact with the respective inclined faces 18, 26 of the first pusher 15 and the second pusher 16 and therefore, the crown portion s1 is supported by friction at that occasion and therefore, the crown portion s1 is not deformed to an M-like shape. In this way, the leg portion s2 is held by the guide portions 17, 21, the crown portion s1 is held by the inclined faces 18, 26 and therefore, a shape of the bent portion is ensured to be held.

Figure 9:
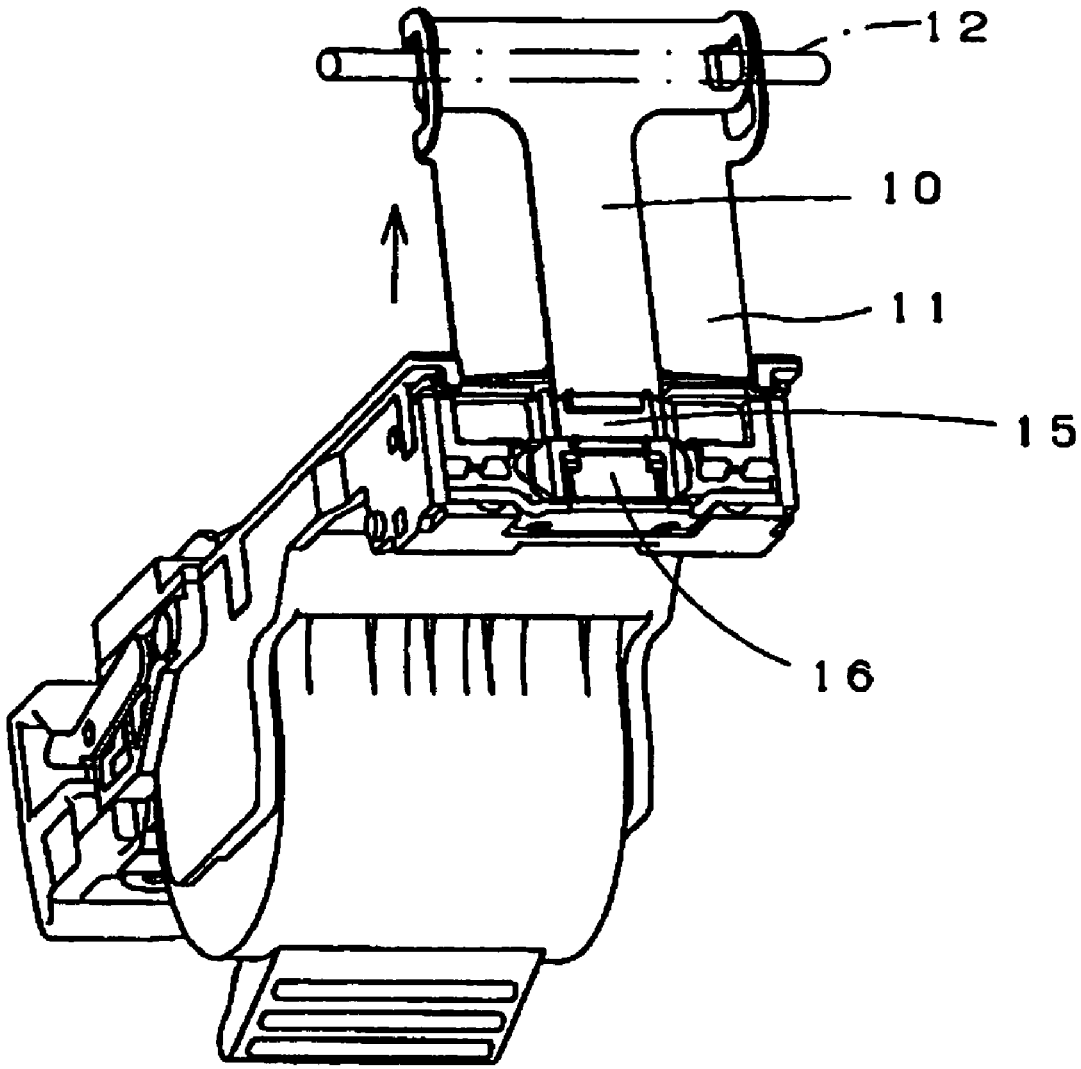
[FIG. 9]

When the drive shaft 12 is operated to return after having been operated to bind, also the driver plate 10 is operated to return simultaneously, however, as shown by FIG. 9, the forming plate 11 is returned slightly retardedly. When the driver plate 10 is moved to return, first, the second pusher 16 is moved to the side of the face plate 8 by the spring 25 and therefore, the leg portion s2 of the staple s formed in the C-shape is pressed to be carried to the strike out path 9 by moving the forming plate 11 to an end of movement. Successively, also the first pusher 15 is carried to the strike out path 9 similarly. In this way, the staple s is fed to the strike out path 9 in two stages and therefore, the staple s can firmly be supplied.

Further, although in the above-described example, the unformed staple is formed by the forming plate in one motion piece by piece, two or three pieces of the unformed staples may be formed in one motion.

Further, the staple cartridge and the forming plate/driver plate may be provided upside down converse to the above-described example.

Although the invention has been explained in details and in reference to specific embodiments, it is apparent for the skilled person that the invention can variously be changed and modified without deviating from the spirit and the range of the invention.

The application is based on Japanese Patent Application (Japanese Patent Application No. 2004-212339) filed on Jul. 20, 2004 and contents of which are incorporated herein by reference.

INDUSTRIAL APPLICABILITY

According to one or more embodiments of the invention, when the staple in the C-shape is struck out by the driver plate, the leg portion is struck out by being supported by the first pusher and the second pusher. Meanwhile, also the forming plate is driven successively to the driver plate and therefore, the first pusher is pushed away to be remote from the face plate by the forming plate and therefore, also the staple loses support by that amount. However, at that occasion, the leg portion of the staple has already been pushed to and supported by the side of the face plate by the second pusher and therefore, the staple is struck out to the binding sheet in a correct attitude to penetrate therethrough. Thereafter, although also the second pusher is pushed away to be remote from the face plate by the forming plate, at this occasion, the leg portion of the staple is inserted to and supported by the binding sheet and therefore, the attitude of the staple does not become unstable. Therefore, when the staple is struck out, the staple is guided to be held always in the stable attitude and therefore, when the staple is penetrated through the binding sheet, the staple is not buckled and the smooth and firm binding operation can be carried out.

Further, according to one or more embodiments of the invention, the first pusher and the second pusher are formed with portions of guiding the leg portions of the staple and therefore, the leg portion can effectively be prevented from being folded to bend to the inner side (other leg side) by the resistance of penetrating through the binding sheet. Therefore, the binding operation can further firmly be carried out.

The invention claimed is:

1. A stapler comprising:

a path of supplying connected staples;

a face plate arranged on a front side of the supply path;

a strike out path provided between a front end face of the supply path and the face plate;

a first pusher provided at an inside of the strike out path and urged to the face plate; and a second pusher provided at the inside of the strike out path, arranged directly underneath the first pusher, and urged to the face plate, wherein the first pusher presses a formed staple to the face plate, and the second pusher presses a leg portion of the formed staple to the face plate, and each pusher is independently movable relative to the other; and a first press portion formed at the first pusher for pressing the formed staple;

first guide portions formed on both sides of the first press portion by way of a stepped difference for guiding inner side faces and back faces of the two leg portions of the formed staple at the inside of the strike out path;

a second press portion formed at the second pusher for pressing the staple; and second guide portions formed on both sides of the second press portion by way of a stepped difference for guiding the inner side faces and back faces of the two leg portions of the staple at the inside of the strike out path; and blade pieces extended to be formed on both outer sides of the first guide portions; and upper end inclined faces formed on upper end edges of the blade pieces, wherein when the upper end inclined faces push back the first pusher by engaging with a staple leg portion of a staple next to the struck-out staple, the struck-out staple is supported by the second pusher.

2. The stapler according to claim 1, further comprising:

a forming plate for forming one staple of the connected staples into a C-shape; and a driver plate held in a state of being laminated with the forming plate for striking out the formed staple.

3. The stapler according to claim 1, wherein the first press portion includes a first inclined face and a first engaging face successive to the first inclined face, and the second press portion includes a second inclined face and a second engaging face successive to the second inclined face.

4. The stapler according to claim 1, wherein a side of a strike out path of the first pusher is formed with a first inclined face, and a first engaging face successive to the first inclined face, and a side of the strike out path of a second pusher is formed with a second inclined face, and a second engaging face successive to the second inclined face.

5. The stapler according to claim 4, wherein when the staple at the inside of the strike out path is struck out by the driver plate and a crown portion of the staple at the inside of the strike out path is engaged with the first engaging face, the first pusher is pushed back against an urge force; and when the forming plate forms a staple adjacent to the staple at the inside of the strike out path and the first pusher is further pushed back, the crown portion of the staple at the inside of the strike out path is supported by the second inclined face.

6. A staple cartridge comprising:

a path of supplying connected staples;

a first pusher provided on a lower side of the supply path and urged to a direction of supplying the connected staple; and a second pusher provided directly underneath of the first pusher, urged to the direction of supplying the connected staples and independently movable relative to the first pusher;

a first press portion formed at the first pusher for pressing the formed staple;

first guide portions formed on both sides of the first press portion by way of a stepped difference for guiding inner side faces and back faces of the two leg portions of the formed staple at the inside of the strike out path;

a second press portion formed at the second pusher for pressing the formed staple;

second guide portions formed on both sides of the second press portion by way of a stepped difference for guiding inner side faces and back faces of the two leg portions of the formed staple at the inside of the strike out path; and blade pieces extended to be formed on both outer sides of a first guide portions of the first pusher; and upper end inclined faces formed on upper end edges of the blade pieces, wherein when the upper end inclined faces push back the first pusher by engaging with a staple leg portion of a staple next to the struck-out staple, the struck-out staple is supported by the second pusher.

7. The staple cartridge according to claim 6, wherein the first pusher is made to be able to advance and retract to and from a strike out path formed between a front end face of the supply path and a face plate, and the second pusher is made to be able to advance and retract to and from the strike out path.

8. A stapler comprising:

a path of supplying connected staples;

a face plate arranged on a front side of the supply path;

a strike out path provided between a front end face of the supply path and the face plate;

a first pusher provided at an inside of the strike out path and urged to the face plate; and a second pusher provided at the inside of the strike out path, arranged directly underneath a staple strike out port of the first pusher, and urged to the face plate;

wherein the first pusher and the second pusher are independently movable relative to each other; and a first press portion formed at the first pusher for pressing the formed staple;

first guide portions formed on both sides of the first press portion by way of a stepped difference for guiding inner side faces and back faces of the two leg portions of the formed staple at the inside of the strike out path;

a second press portion formed at the second pusher for pressing the staple; and second guide portions formed on both sides of the second press portion by way of a stepped difference for guiding the inner side faces and back faces of the two leg portions of the staple at the inside of the strike out path;

blade pieces extended to be formed on both outer sides of the first guide portions; and upper end inclined faces formed on upper end edges of the blade pieces, wherein, when the upper end inclined faces push back the first pusher by engaging with a staple leg portion of a staple next to the struck-out staple, the struck-out staple is supported by the second pusher.

9. The stapler according to claim 8, further comprising:

a forming plate for forming to bend to form a front one staple of the connected staples into a C-shape; and a driver plate held in a state of being laminated with the forming plate for striking out the formed staple;

wherein the first pusher presses the formed staple to the face plate, and the second pusher presses a leg portion of the formed staple to the face plate.

10. The stapler according to claim 8, wherein the first press portion includes a first inclined face and a first engaging face successive to the first inclined face, and the second press portion includes a second inclined face and a second engaging face successive to the second inclined face.

11. The stapler according to claim 8, wherein a side of a strike out path of the first pusher is formed with a first inclined face, and a first engaging face successive to the first inclined face, and a side of a strike out path of the second pusher is formed with a second inclined face, and a second engaging face successive to the second inclined face.

12. The stapler according to claim 11, when the staple at the inside of the strike out path is struck out by the driver plate and a crown portion of the staple at the inside of the strike out path is engaged with the first engaging face, the first pusher is pushed back against an urge force; and when the forming plate forms the staple at a successive position and the first pusher is further pushed back, the crown portion of the staple at the inside of the strike out path is supported by the second inclined face.

* * * * *